US011112185B2

(12) United States Patent
Whalley et al.

(10) Patent No.: US 11,112,185 B2
(45) Date of Patent: Sep. 7, 2021

(54) PROFILED JOINT FOR HEAT EXCHANGER

(71) Applicant: HS Marston Aerospace Limited, Wolverhampton (GB)

(72) Inventors: Stephen Whalley, Telford (GB); Rafal Lewandowski, Zarow (PL)

(73) Assignee: HS MARSTON AEROSPACE LIMITED, Wolverhampton (GB)

( * ) Notice: Subject to any disclaimer, the term of this patent is extended or adjusted under 35 U.S.C. 154(b) by 108 days.

(21) Appl. No.: 15/837,091

(22) Filed: Dec. 11, 2017

(65) Prior Publication Data

US 2018/0172356 A1 Jun. 21, 2018

(30) Foreign Application Priority Data

Dec. 16, 2016 (EP) ..... 16275175

(51) Int. Cl.
*F28D 9/00* (2006.01)
*F28F 3/02* (2006.01)
*F28F 13/06* (2006.01)

(52) U.S. Cl.
CPC ..... *F28D 9/0068* (2013.01); *F28F 3/025* (2013.01); *F28F 13/06* (2013.01)

(58) Field of Classification Search
CPC ..... F28D 9/0062; F28D 9/0068; F28F 3/025; F28F 3/027; F28F 2250/108
See application file for complete search history.

(56) References Cited

U.S. PATENT DOCUMENTS

| | | | | |
|---|---|---|---|---|
| 4,282,927 | A | 8/1981 | Simmons | |
| 4,862,952 | A * | 9/1989 | Tarasewich | F28D 9/0068 165/54 |
| 5,287,918 | A | 2/1994 | Banks et al. | |
| 2005/0098309 | A1 * | 5/2005 | Kang | F28D 9/0018 165/166 |
| 2011/0180242 | A1 * | 7/2011 | Urata | F28D 9/0068 165/166 |

FOREIGN PATENT DOCUMENTS

| | | | | |
|---|---|---|---|---|
| DE | 2540144 A1 | 8/1976 | | |
| FR | 2704310 A1 | 10/1994 | | |
| GB | 867214 A | 5/1961 | | |
| GB | 1569499 A * | 6/1980 | | F28F 3/025 |
| GB | 2110812 A | 6/1983 | | |

OTHER PUBLICATIONS

European Search Report for Application No. 16275175.4-1602, dated Jun. 16, 2017, 6 pages.

* cited by examiner

*Primary Examiner* — Eric S Ruppert
(74) *Attorney, Agent, or Firm* — Cantor Colburn LLP

(57) ABSTRACT

A secondary heat exchange surface channel portion for a heat exchanger 7 comprises multiple joints between adjacent channel portions 2*a*, 2*b*, 101, for redirecting flow of fluid along a tortuous path. One of the channel portions at each joint has a concave profiled edge face 120, thereby providing a gap 110 between adjacent channel portions. The primary use of this arrangement is in heat exchangers which have corrugated secondary heat exchange surfaces.

20 Claims, 8 Drawing Sheets

PROFILED JOINT FOR HEAT EXCHANGER

FOREIGN PRIORITY

This application claims priority to European Patent Application No. 16275175.4 filed Dec. 16, 2016, the entire contents of which is incorporated herein by reference.

TECHNICAL FIELD

The present disclosure relates to a secondary heat exchange surface channel portion for a heat exchanger and a joint configuration for a fluid channel of a heat exchanger having such a secondary heat exchange surface channel portion. In particular, it relates to a joint configuration between first and second channel portions at a location of a change of direction of the fluid flow. The disclosure further extends to a heat exchanger comprising the joint configuration and a method of manufacturing such a joint configuration.

BACKGROUND OF THE INVENTION

It is known in the art of heat exchangers, in particular of the plate-and-fin type of heat exchanger, to provide alternating layers of "tube plate" and corrugated secondary heat exchange surface. The tube plates are thin, flat plates comprising within them tubes for flow of a first fluid. On either side of the tube plates, a second fluid can flow along (i.e. in a longitudinal direction of) the corrugations of the corrugated secondary heat exchange surface. The corrugated heat exchange surface may have a herringbone configuration, i.e. with sharp corners in the corrugation. Thus heat can be exchanged between the first fluid in the tube plates and the second fluid outside the tube plates which flows along the corrugated secondary heat exchange surface. The configuration of the tube plates and corrugated secondary heat exchange surfaces can be supported by spacer bars at the edges of the heat exchanger, as well as with centralised spacer bars for serpentine arrangements of corrugated secondary heat exchange surfaces. The flow of the first fluid through the heat exchanger is generally perpendicular to the flow of fluid through the corrugated secondary heat exchange surfaces, except where the flow through the corrugated secondary heat exchange surfaces changes direction, e.g. in a serpentine arrangement, i.e. the "turnaround portion".

In heat exchangers where the flow of secondary fluid meanders in a serpentine configuration, and/or turns a single corner to exit from the heat exchanger into a tank, the direction of the corrugations of the corrugated secondary heat exchange surface needs to match the direction of secondary fluid flow. It is difficult, costly and labour intensive to produce a corrugated secondary heat exchange surface with curved corrugations around the corner where the flow changes direction. Instead, sections of corrugated sheeting are provided, each having an orientation of the corrugations in accordance with the intended secondary fluid flow direction along that section of the corrugated sheet. The sections of corrugated sheeting are arranged to meet at a mitre joint, i.e. the corrugations are cut across at an angle and then two angled edge faces of adjacent sections are placed together to allows the secondary fluid flow to pass from one corrugated sheet section to the next. Such mitre joints are known, as shown in GB 867,214.

A problem with such mitre joints is that if the two sections are exactly adjacent one another, there can be difficulty with the fluid flow passing from one corrugated sheet section to the next, since the relatively angled corrugations of one corrugated sheet section can occlude the relatively angled corrugations of the second sheet section if, as is wont to happen, the longitudinal edges of the corrugations are not fully aligned. This results in a phenomenon known as "flow starvation", where the secondary fluid flow is reduced or prevented from flowing where the corrugations are occluded.

One solution can be seen in FIG. 1, which shows a perspective view of a plate-and-fin heat exchanger 7. The heat exchanger 7 comprises tube plates 6, and corrugated secondary heat exchange surfaces comprising straight-cut sections of corrugated sheet 22*a*, 22*b* and angle-cut sections of corrugated sheeting 1, 2*a*, 2*b* (the corrugations are omitted from the Figure for clarity). The tube plates 6 and sheet sections 1, 2*a*, 2*b* are supported by spacer bars 3, 4, 5. The arrows in FIG. 1 show the intended direction of fluid flow through the secondary heat exchange surface, which makes a 180° turn at two subsequent mitre joints. In this arrangement, the corrugated sheet portions (sections) are provided with a divergent angle $\alpha$ therebetween, which can be seen more clearly in FIG. 2, such that the sheet portions 1, 2*a*, 2*b* abut one another at one vertex 8 of each mitre joint and diverge therefrom to leave an angled gap 10, which is widest at the opposite vertex 9 of each mitre joint. Thus flow starvation can be reduced since at least the corrugations on adjacent corrugated sheet sections 1, 2*a*, 2*b* closer to the vertex 9 of each of the mitre joints are spaced apart.

The secondary heat exchange surfaces 1, 2*a*, 2*b* also have another function, which is to provide structural support for the tube plates 6 in the fin-and-plate heat exchanger 7. However, the gap 10 between the sections of the corrugated sheet 1, 2*a*, 2*b* causes a reduction in contact area between the corrugated sheets and the tube plates 6 and thus a consequent reduction in support of the tube plates. This causes the problem of increased susceptibility of the tube plates to failure under increased pressure loading of the heat exchanger 7.

A theoretical solution to this problem would be to narrow the gap 10 by providing a smaller divergent angle $\alpha$ between the adjacent corrugated sheet sections. However there are both practical and theoretical problems with doing so.

The practical problem is that the heat exchange surfaces 1, 2*a*, 2*b* are cut using wire erosion, which under current manufacturing standards gives a linear tolerance of ±0.010 inches (±0.25 mm). Thus designing to provide a smaller divergent angle $\alpha$ between the adjacent corrugated sheet sections may not in reality result in a gap 10 being produced at all due to the tolerance. In order to guarantee a gap 10, the extremes of the tolerance need to be accounted for on both corrugations, which as described above results in a large gap and a large unsupported area at vertex 9, causing the tube plates 6 to be weaker in this area.

The theoretical problem with narrowing the gap 10 is that although this results in improved support of the tube plates 6, it diminishes the benefit of the gap 10 near the vertex 8 where the corrugated sheet sections 1, 2*a*, 2*b* abut. The result is increased occlusion of the fluid flow path near the vertex 8, i.e. a return to the original flow starvation problem.

The present disclosure provides a solution to at least some of the above problems.

SUMMARY

From one aspect, the present disclosure provides a secondary heat exchange surface channel portion for a heat exchanger, the channel portion being configured to direct fluid flow, wherein the channel portion has an edge which is at an angle divergent to the direction of fluid flow provided by the channel portion; and wherein the edge has an edge face, the edge face being concave in shape.

In embodiments, the concave edge face may be curved.

In embodiments, the concave edge face may comprise at least two planar portions having at least one excluded obtuse angle. The angle may be between 160° and 180°, preferably between 170° and 180°, more preferably between 175° and 180° and further preferably between 176° and 178°.

In embodiments, the channel portion may comprise a corrugated structure having plain, serrated or herringbone corrugations arranged such that the longitudinal direction of the corrugations is parallel to the direction of fluid flow past the channel portion.

In embodiments, the edge face may diverge from the direction of fluid flow by an angle of between 30° to 60°, and preferably by 45°.

In embodiments, the channel portion may have a further edge which is at an angle divergent to the direction of fluid flow provided by the channel portion, and wherein the further edge has a further edge face, the further edge face being concave in shape. The concave further edge face may be curved or may comprise at least two planar portions having at least one excluded obtuse angle.

In a further aspect, the present disclosure provides a joint configuration for a fluid channel of a heat exchanger, comprising a joint between first and second channel portions where fluid flow is to change direction, wherein the first channel portion is configured to direct fluid flow in a first direction and comprises a first edge at an angle divergent from the first direction, the first edge having a first edge face; and the second channel portion is configured to direct fluid flow in a second direction which is at an angle of less than 180° relative to the first direction, the second channel portion comprising a second edge at an angle divergent from the second direction, the second edge having a second edge face; wherein the joint is a first joint between the first edge face of the first channel portion and the second edge face of the second channel portion; wherein at least one of the first and second channel portions is a secondary heat exchange surface channel portion as claimed in any preceding claim, such that at least one of the first edge face and the second edge face is concave in shape, so as to provide a gap between the first and second edge faces of the first and second channel portions.

In embodiments, a dimension of the gap is larger nearer to the centre of the gap than further from the centre of the gap.

In embodiments, the second channel portion further comprises a third edge face at an angle divergent from the second direction and which is spaced from the second edge face in a longitudinal direction of the second channel portion; wherein the joint configuration further comprises a third channel portion for directing fluid flow in a third direction which is at an angle of less than 180° relative to the second direction, the third channel portion comprising a fourth edge at an angle divergent from the third direction, the fourth edge having a fourth edge face; wherein the joint further comprises a second joint between the third edge face of the second channel portion and the fourth edge face of the third channel portion; and wherein at least one of the third edge face and the fourth edge face is concave in shape, so as to provide a gap between the third and fourth edge faces of the second and third channel portions.

In embodiments, the angle between the flow directions of channel portions to be joined at a joint may be in the range of 60° to 120° and preferably substantially orthogonal.

In another aspect, the disclosure provides a heat exchanger comprising the joint configuration as described above. The heat exchanger may be a plate and fin heat exchanger, said fluid channel being a fin.

In yet a further aspect, the disclosure provides a method of manufacturing a joint configuration for a fluid channel of a heat exchanger between a first and second channel portion at a location of a change of direction of the fluid flow, comprising: providing a first channel portion for directing fluid flow in a first direction, with a first edge face at an angle divergent from the first direction; providing a second channel portion for directing fluid flow in a second direction with a second edge face at an angle divergent from the second direction, wherein the second direction is at an angle of less than 180° relative to the first direction, profiling at least one of the first edge face and the second edge face in a concave shape; and arranging the first channel portion and the second channel portion such that the joint is a first joint between the first edge face of the first channel portion and the second edge face of the second channel portion, comprising a gap between the first and second channel portions provided by the at least one profiled edge face.

In embodiments, the method further comprises providing the second channel portion with a third edge face at an angle divergent from the second direction and which is spaced from the second edge face in a longitudinal direction of the second channel portion, providing a third channel portion for directing fluid flow in a third direction with a fourth edge face which is not parallel to the third direction, wherein the third direction is at an angle of less than 180° relative to the second direction, profiling at least one of the third edge face and the fourth edge face in a concave shape; and arranging the second channel portion and the third channel portion such that the joint is a first joint between the third edge face of the second channel portion and the fourth edge face of the third channel portion, comprising a gap between the first and second channel portions provided by the at least one profiled edge face.

In embodiments, the step of profiling may comprise providing the respective edge face with a curve; and/or providing the respective edge face with at least two planar portions having at least one excluded obtuse angle between the planar portions. The angle may be between 160° and 180°, preferably between 170° and 180°, more preferably between 175° and 180° and further preferably between 176° and 178°.

In embodiments, the channel portions comprise corrugated sheeting, arranged such that the longitudinal direction of the corrugations is parallel to the flow direction in the respective channel portions. The corrugated sheeting may have a herringbone configuration.

In embodiments, the angle between the flow directions of adjacent channel portions is in the range of 60° to 120° and preferably substantially orthogonal.

BRIEF DESCRIPTION OF THE DRAWINGS

Preferred embodiments of the disclosure will now be described by way of example only and with reference to the following drawings, in which.

DETAILED DESCRIPTION

Figure 1:
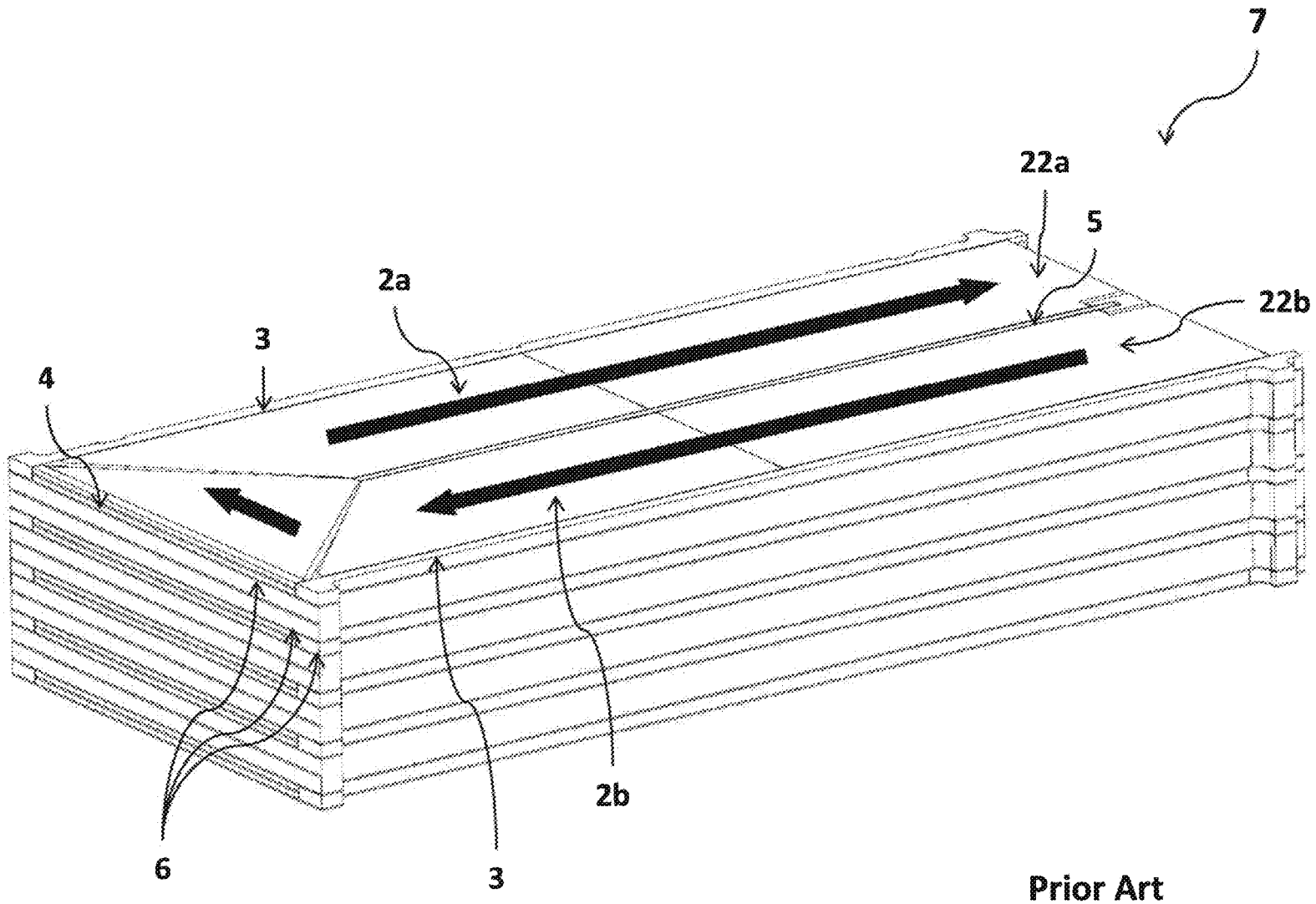
Prior Art Figure 1
FIG. 1 shows a schematic perspective view of a prior art heat exchanger, showing the direction of secondary fluid flow through the heat exchanger.

In the drawings, like reference signs denote like features.

Figure 3:
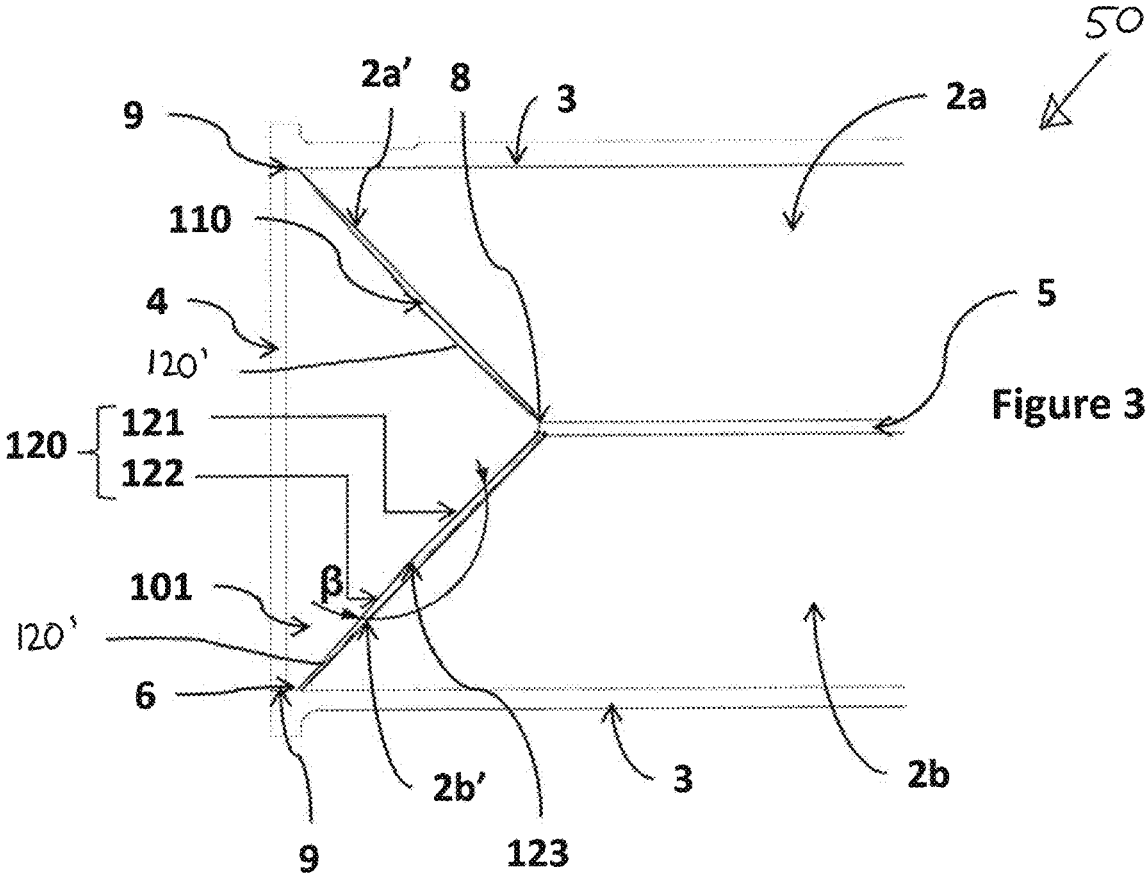
FIG. 3 shows a schematic plan view of a joint configuration according to a first embodiment of the disclosure, with a profiled channel portion.

FIG. 3 depicts a first embodiment of the present disclosure showing a joint configuration 50 for a fluid channel of a heat exchanger (such as a plate and fin type heat exchanger of the type illustrated in FIG. 1). The joint configuration 50 is between a first channel portion 2*a*, a second channel portion 101 and a third channel portion 2*b* of a secondary heat exchange surface of a heat exchanger (and which may be termed secondary heat exchange surface channel portions). Each of the channel portions 2*a*, 2*b*, 101 directs the flow of fluid in a different direction over the surface. Thus the directions of fluid flow in the first and third channel portions 2*a*, 2*b* are parallel and opposite to each other, while the flow in the second channel portion 101 is orthogonal to the direction of flow in the other two channel portions. The fluid flow through the heat exchanger therefore follows a "C-shape", flowing around the central spacer bar 5.

Figure 6:
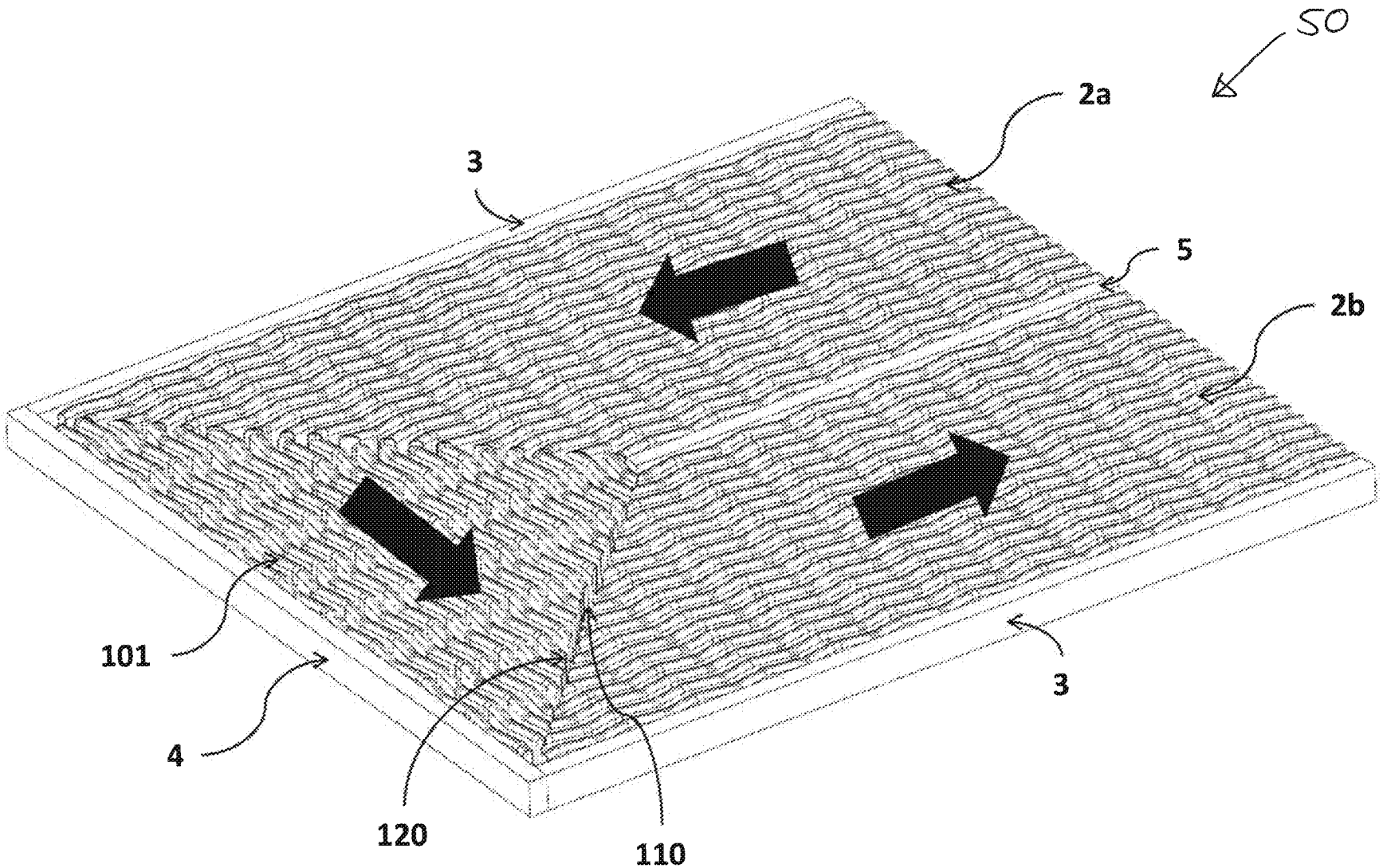
FIG. 6 shows a schematic perspective view of the joint configuration of FIG. 3, with the corrugations being shown.

Each of the channel portions 2*a*, 2*b*, 101 comprises a corrugated surface having a herringbone configuration as shown in FIG. 6 (the corrugations are omitted in FIG. 3 for clarity). FIG. 6 also shows the direction of fluid flow through each channel portion with arrows. As can be seen, the longitudinal direction of the corrugations in each of the channel portions 2*a*, 2*b*, 101 is aligned with the direction of flow through the particular channel portion 2*a*, 2*b*, 101. Hereinafter, the "longitudinal direction" of a channel portion will refer to a direction aligned with the longitudinal direction of the corrugations of that channel portion.

As can be seen from FIGS. 3 and 6, the channel portions 101, 2*a*, 2*b* are joined together using a mitre-type joint. In the embodiments shown, the ends of the first and third channel portions 2*a*, 2*b* forming part of the joint have straight edges 2*a*', 2*b*'cut at an angle to the longitudinal direction of each of the channel portions as is conventionally known. In other words, these edges are at an angle divergent from the longitudinal direction of the channel portions and thus from the direction of flow provided by these channel portions.

Figure 4:
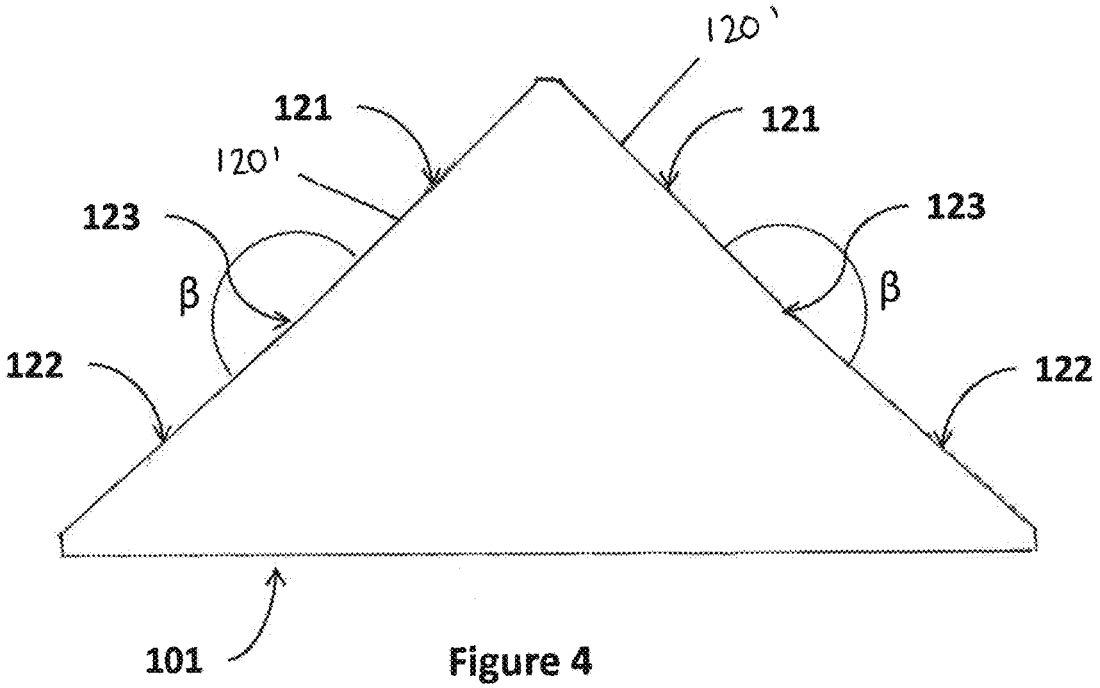
FIG. 4 shows a schematic plan view of the profiled channel portion of FIG. 3.
Figure 5:
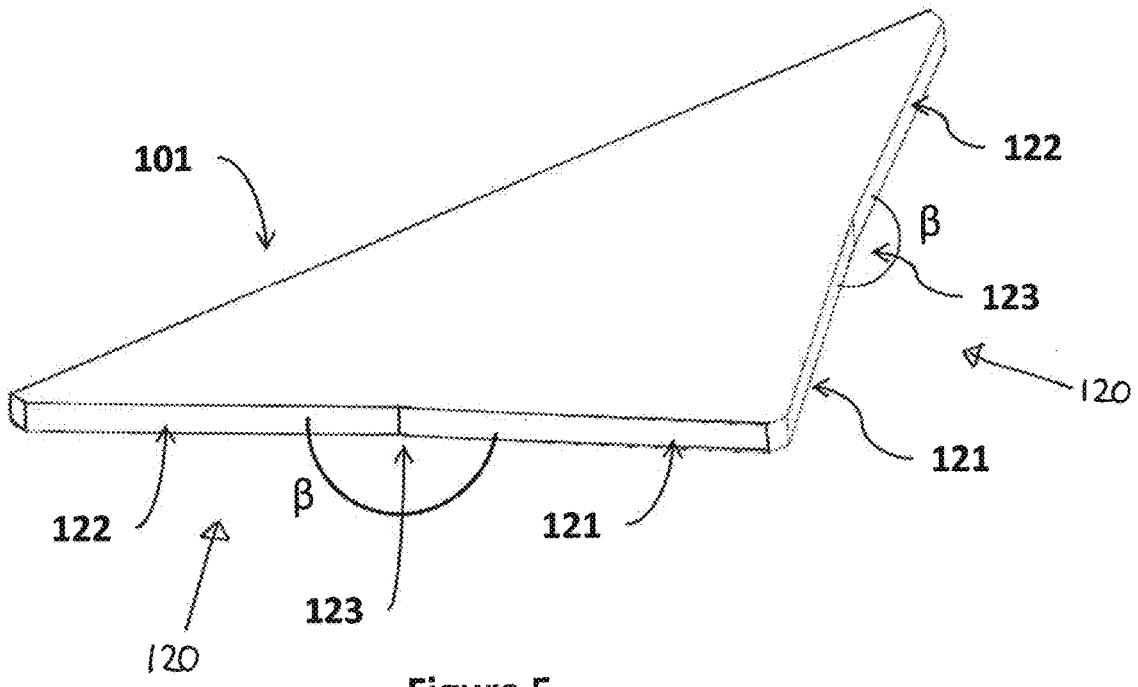
FIG. 5 shows a schematic perspective view of the profiled channel portion of FIG. 3.

As can be seen most clearly in FIGS. 4 and 5, the second channel portion 101 has two edges 120', each having a profiled (e.g. shaped) edge face 120 (which may also be termed a profiled edge surface or profiled end). Thus, the second channel portion 101 has two profiled edge faces 120, one on each side where the second channel portion 101 connects to the first channel portion 2*a* and third channel portion 2*b* respectively. It will be appreciated that by "edge face" is meant the face of the edge extending over the depth of the channel portion (the depth being substantially perpendicular to the flow direction provided).

Figure 7:
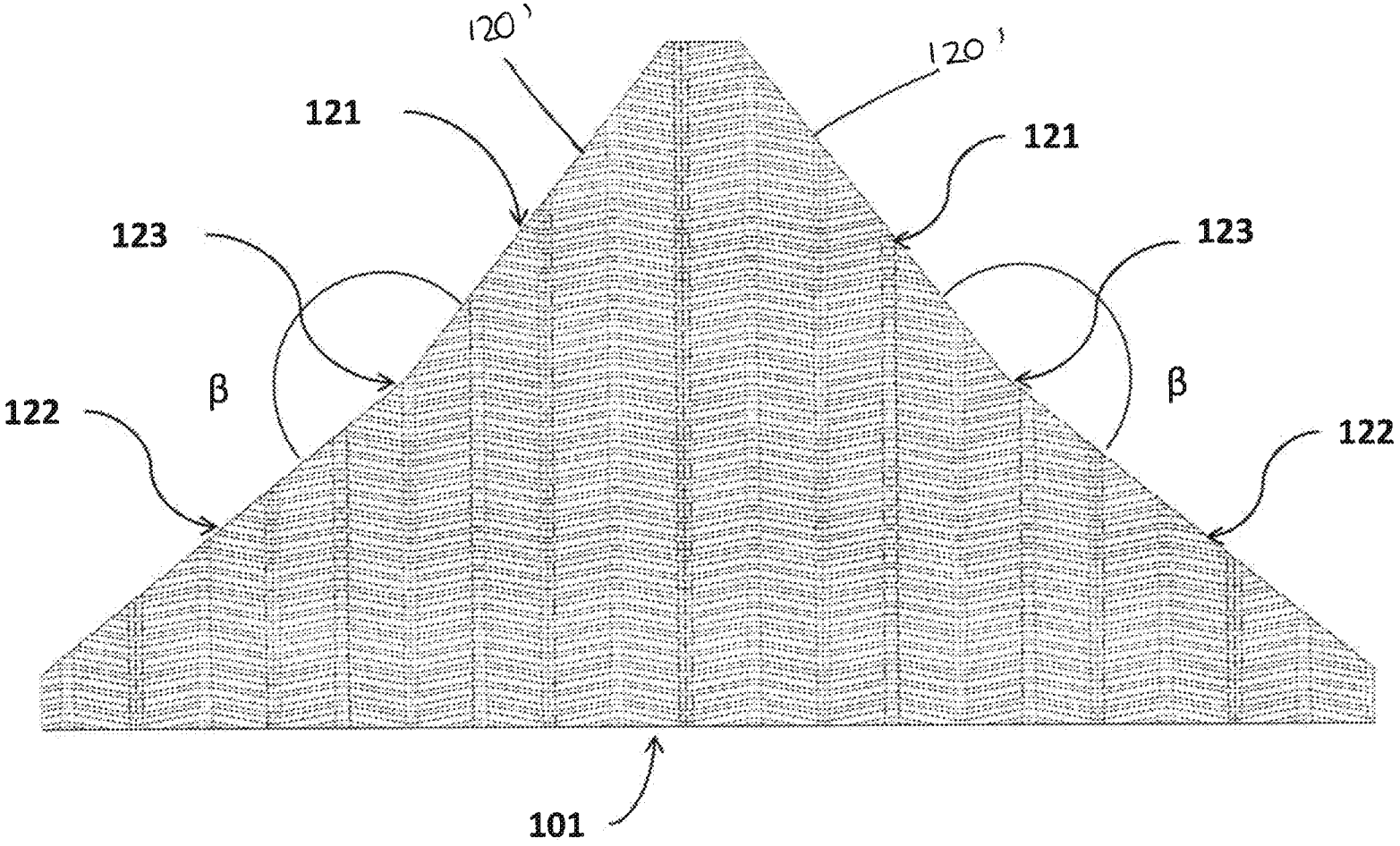
FIG. 7 shows a schematic exaggerated plan view of the profiled channel portion of FIG. 6.
Figure 8:
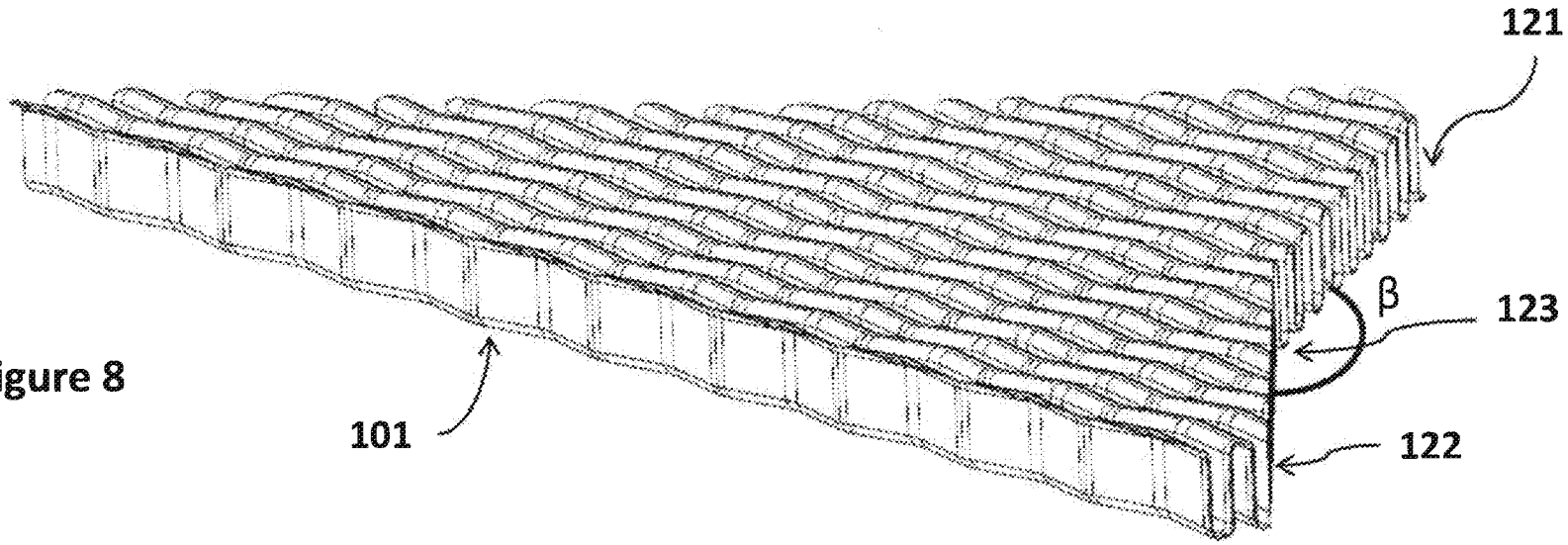
FIG. 8 shows a schematic exaggerated perspective view of the profiled channel portion of FIG. 6.

Each profiled edge face 120 comprises two planar portions 121, 122 which meet at a vertex 123 and is profiled to comprise an internal reflex angle which is less than 270° and an external obtuse angle β at the vertex 123 as shown clearly in FIG. 3. Thus, the edge face is concave in shape (and consequently is a concave profiled edge face). A channel portion having such a concave shaped edge face may be considered as being a concave polygon shape. The profiled edge face can also be seen with reference to FIGS. 7 and 8 which show the angle β in a schematic exaggerated fashion.

In implementation, the angle β will be sized to fit the geometry of the channel portions and corrugations, such that the gap between the channel portions 101, 2*a*, 2*b* at the vertex 123 enables sufficient fluid can flow at the vertices 8, 9 between channel portions 2*a*, 2*b*, 101. In one particular embodiment, the gap may be nominally 0.05 inches (1.3 mm).

In one embodiment, the angle β may be between 160° and 180°, preferably between 170° and 180°, more preferably between 175° and 180° and further preferably between 176° and 178°.

In one particular embodiment, the gap between the channel portions 101, 2*a*, 2*b* at the vertex 123 is 0.05 inches (1.3 mm) and the angle β is between 176° and 178°.

The vertex 123 may be located at the centre of each shaped edge face 120, or may be skewed from the centre in either direction.

These profiled edge faces 120 result in angular gaps 110 between the first and second channel portions 2*a*, 101 and between the second and third channel portions 101, 2*b*. The gaps 110 narrow towards each vertex 8, 9 of the joint and get wider towards the vertex 123. Consequently, a dimension of the gap is larger nearer to the centre of the gap than further from the centre of the gap. As can be seen in FIG. 6, the gaps 110 ensure that corrugations on adjacent channel portions 2*a*, 101 and 101, 2*b* are not occluded by each other. Thus there is improved transfer of fluid from one channel portion to the next due to even flow distribution, and reduced flow starvation.

Figure 2:
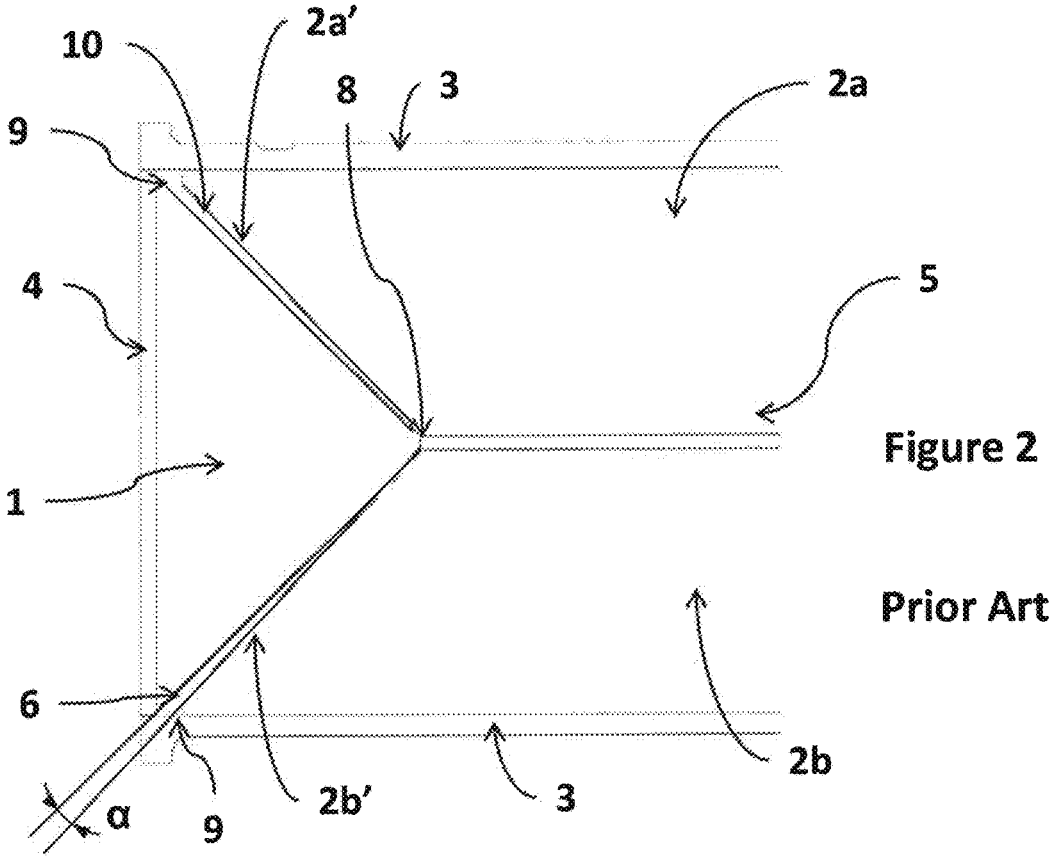
Figure 2 Prior Art
FIG. 2 shows a schematic plan view of a prior art joint configuration at a location of change of direction of fluid flow.

As can be seen more clearly in FIG. 3, the profiled edge face 120 of the second channel portion 101 allows the channel portions 2*a*, 2*b*, 101 to be closer to one-another at the vertices 9 than in the prior art heat exchanger of FIGS. 1 and 2. As a result of the smaller gaps at the vertices 9, more surface area is available for connection of the secondary heat exchange surfaces comprising channel portions 2*a*, 2*b*, 101, resulting in improved support of the tube plates 6 of the heat exchanger, thereby maintaining structural integrity even under increased fluid pressure conditions.

Figure 9:
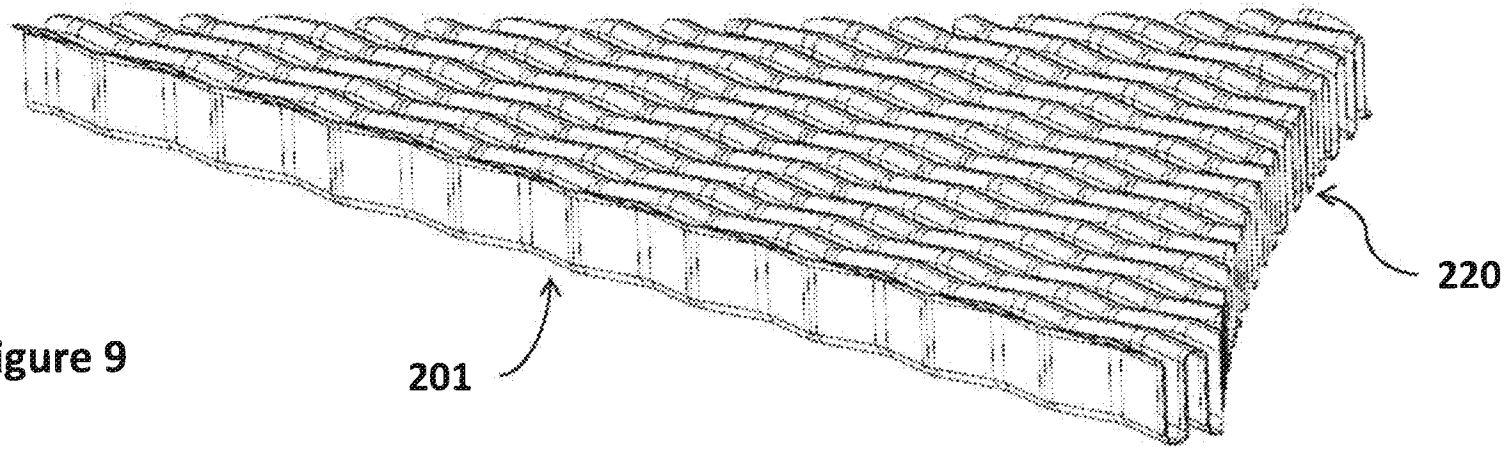
FIG. 9 shows a schematic exaggerated perspective view of a profiled channel portion of a joint configuration according to a second embodiment.

FIG. 9 shows a second embodiment of the present disclosure. In this embodiment, profiled edge face 220 of the second channel portion 201 comprises a concave curved face which can be present on one or both profiled edge faces of the second channel portion 201 instead of the planar portions of the first embodiment.

The curved face 220 of the second channel portion 201 provides the same benefits described above regarding the improved fluid flow from one channel portion to the next and increased surface area for joining and supporting the tube plates.

While forming a curved face 220 may be of similar simplicity as forming planar portions 121, 122, the planar portions 121, 122 may be easier to inspect subsequently for manufacturing tolerance and quality than the curved face 220.

Whilst in the first and second embodiments the second channel portion 101 has two profiled edge faces, in other embodiments it may have only one profiled edge face. Such an embodiment is shown in FIGS. 10 and 11.

Figure 10:
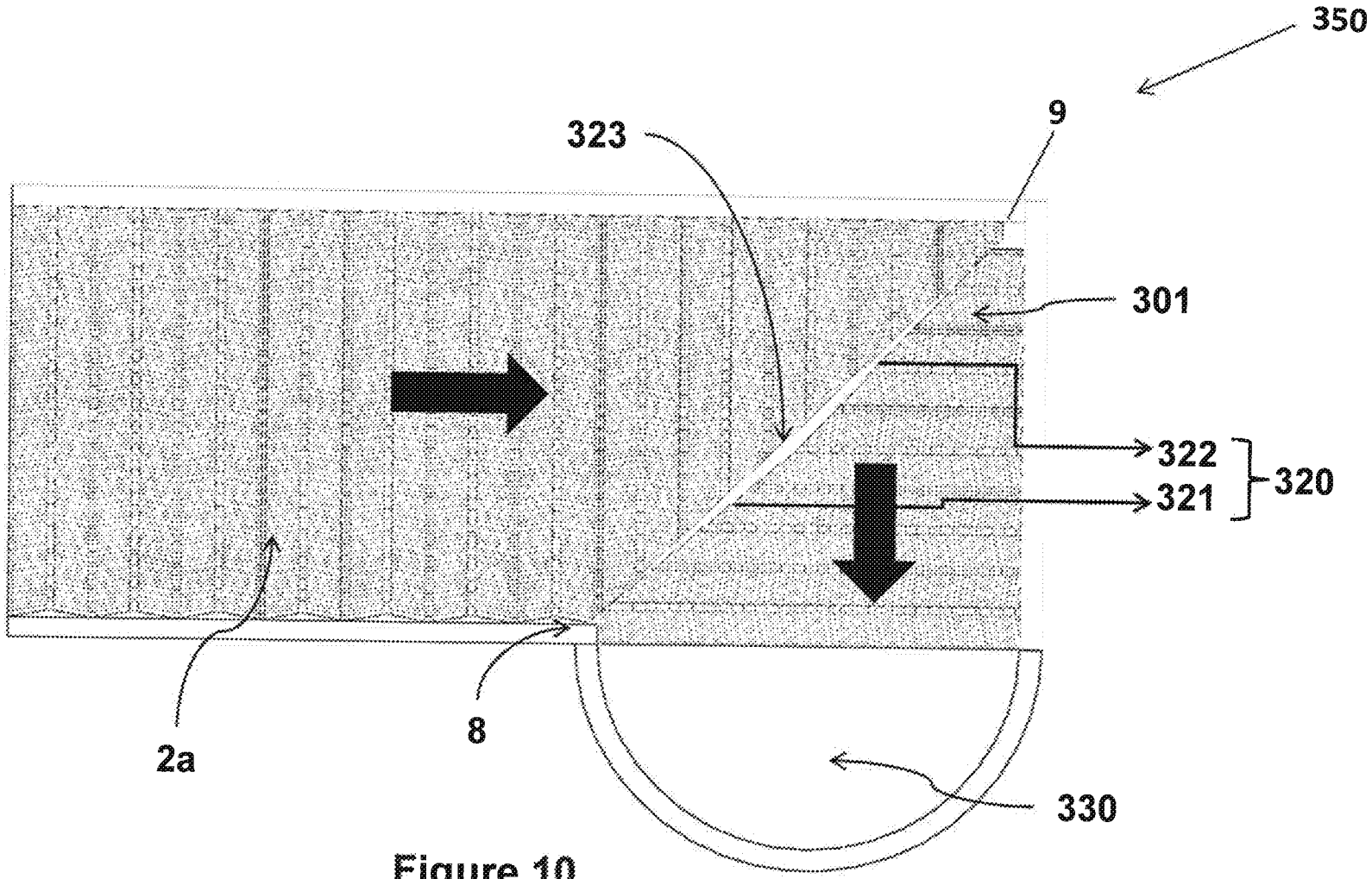
FIG. 10 shows a schematic plan view of a third embodiment of a joint configuration of the present disclosure.
Figure 11:
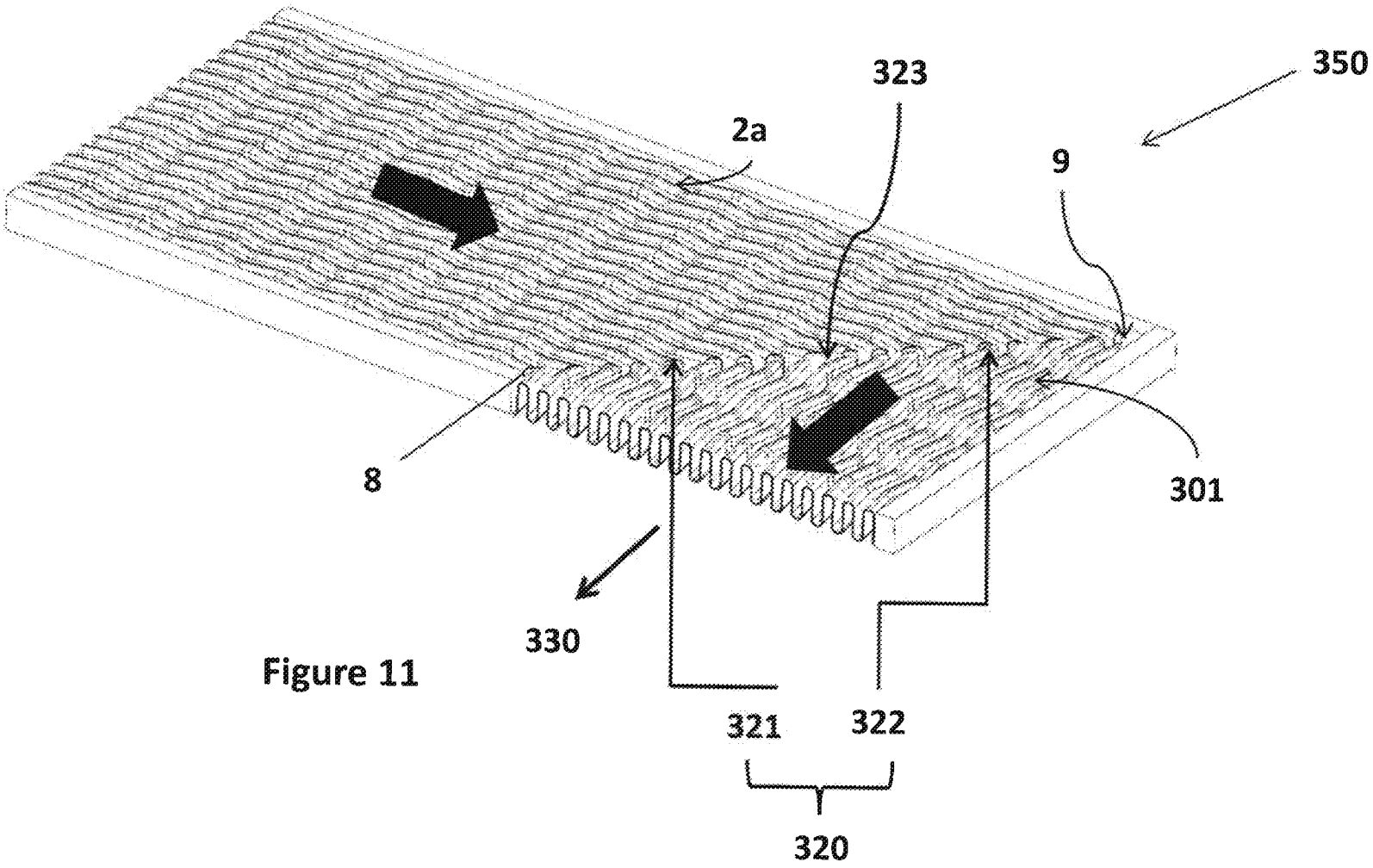
FIG. 11 shows a perspective view of the joint configuration of FIG. 10.

FIGS. 10 and 11 show a third embodiment of the present disclosure. In this embodiment, the joint configuration 350 comprises only two channel portions, namely first channel portion 2*a* and second channel portion 301. There is no third channel portion because the fluid flow only turns a single corner before exiting the heat exchanger into a turnaround tank 330.

As shown, in the third embodiment, the second channel portion 301 comprises one profiled edge face 320, comprising planar portions 321, 322 having an angle therebetween at a vertex 323. As above, the benefits of the resultant gap between the first and second channel portions 2*a*, 301 and the support at the vertex 9 of the pipe layers, or "tube plates" are realised in this embodiment.

In all of the above embodiments of the present disclosure, at the joint between two channel portions, at least one of the channel portions has a concave-shaped edge face, i.e. such that there exists a chord joining two points on the edge face which lies outside of the boundary of the profiled channel portion. Such a concave shaped edge face may comprise several straight edge faces, and/or one or more curved edge faces.

It will be clearly understood, particularly with reference to the drawings, that the concave shape of the edge face means that the edge face is concave along its length from one end to the other, i.e. when moving from one end to the other along the length of the edge face, the edge face extends inwardly until it reaches a certain point and then extends outwardly again. It is not intended to mean that the edge face extends inwardly and then outwardly when moving from the top to the bottom over the depth of the edge face.

While the above described embodiments of the Figures are preferred, the skilled person will clearly understand that alternatives may fall within the scope of this disclosure. For example, the profiled edge face may be on either or both of the facing (opposite) edge faces of adjacent channel portions. Thus, in one embodiment, the ends of at least one of the first and third channel portions 2*a*, 2*b* have profiled edge faces in the same way as the edge faces 120, 220, 320 as described above. This may be in addition to or instead of the profiled edge faces 120, 220, 320 of the second channel portion 101, 201, 301.

Alternatively or additionally, the any profiled edge face may have two or more planar portions. Alternatively or additionally, any profiled edge face may include a curved surface.

Having two planar portions including an obtuse angle therebetween may allow easier manufacture and thus reduced cost of production compared with a curved surface.

All embodiments of the disclosure therefore provide a joint configuration in which the fluid flow path has reduced occlusion so allowing fluid to flow easily around the joint, while still providing sufficient support for the pipe. A result of the improved fluid flow through the channel portions of the heat exchanger is better heat transfer and thus more efficient heat exchangers.

While the present disclosure is of particular benefit to herringbone-type corrugations in a plate-and-fin heat exchanger, the present disclosure is also relevant to other heat exchanger designs and corrugation types, e.g. plain and serrated corrugations.

The above described disclosure—at least in the first embodiment comprising two planar portions 121, 122—halves the length of each angled portion of the edge face compared to conventional joint configurations. Additionally, the divergent angle $\alpha$, as defined above for conventional joint configurations, can be reduced, since the vertex 123 of the planar portions 121, 122 can be dimensioned to ±0.010 inches (±0.25 mm) in addition to the end points at vertices 8 and 9. Moreover, there is no need for concern of the manufacturing tolerances of the adjoining pieces, since having the obtuse excluded angle $\beta$ ensures that a gap 110 will always be maintained all the way along the edge face 120. Thus with the same tolerances, a smaller gap 110 can be maintained thereby providing sufficient support for the tube plates 6 without impeding or restricting flow at the joint.

The invention claimed is:

1. A joint configuration for a fluid channel of a heat exchanger, comprising a joint between first and second channel portions where fluid flow is to change direction, wherein the first channel portion is configured to direct fluid flow in a first direction and comprises a first edge at an angle divergent from the first direction, the first edge having a first edge face; and the second channel portion is configured to direct fluid flow in a second direction which is at an angle of less than 180° relative to the first direction, the second channel portion comprising a second edge at an angle divergent from the second direction, the second edge having a second edge face;

wherein the first edge face and the second edge face each have a depth between a respective top of the edge face and a respective bottom of the edge face and a length extending from one end of the respective edge face to the other;

wherein the joint is a first joint between the first edge face of the first channel portion and the second edge face of the second channel portion;

wherein at least one of the first edge face and the second edge face is concave in shape along the length of the edge face, so as to provide a gap between the first and second edge faces of the first and second channel portions; and wherein the gap between the first and second edge faces narrows towards the ends of the edge faces.

2. The joint configuration of claim 1, wherein a dimension of the gap is larger nearer to the centre of the gap than further from the centre of the gap.

3. The joint configuration of claim 1, wherein the second channel portion further comprises a third edge face at an angle divergent from the second direction and which is spaced from the second edge face in a longitudinal direction of the second channel portion;

wherein the joint configuration further comprises a third channel portion for directing fluid flow in a third direction which is at an angle of less than 180° relative to the second direction, the third channel portion comprising a fourth edge at an angle divergent from the third direction, the fourth edge having a fourth edge face;

wherein the first edge face and the second edge face each have a depth between a respective top of the edge face and a respective bottom of the edge face and a length extending from one end of the respective edge face to the other;

wherein the joint further comprises a second joint between the third edge face of the second channel portion and the fourth edge face of the third channel portion; and wherein at least one of the third edge face and the fourth edge face is concave in shape along the length of the edge face, so as to provide a gap between the third and fourth edge faces of the second and third channel portions.

4. The joint configuration of claim 1, wherein the angle between the flow directions of channel portions to be joined at a joint is in the range of 60° to 120°.

5. A heat exchanger comprising the joint configuration of claim 1.

6. The joint configuration of claim 1, wherein the at least one concave edge face is curved.

7. The joint configuration of claim 1, wherein the at least one concave edge face comprises at least two planar portions having at least one excluded obtuse angle.

8. The joint configuration of claim 1, wherein at least one of the first and second channel portions comprises a corrugated structure having plain, serrated or herringbone corrugations arranged such that the longitudinal direction of the corrugations is parallel to the direction of fluid flow past the channel portion.

9. The joint configuration of claim 1, wherein at least one of the first edge face and the second edge face diverges from the respective direction of fluid flow by an angle of between 30° to 60°.

10. The joint configuration of claim 1, wherein at least one of the first and second channel portions has a further edge which is at an angle divergent to the respective direction of fluid flow provided by the channel portion, and wherein the further edge has a further edge face, the further edge face being concave in shape along its length from one end to the other.

11. The joint configuration of claim 10, wherein the concave further edge face is curved or comprises at least two planar portions having at least one excluded obtuse angle.

12. The joint configuration of claim 7, wherein the at least one excluded obtuse angle is between 160° and 180°.

13. The joint configuration of claim 1, wherein the gap between the first and second edge faces narrows towards the ends of the edge faces such that a width of the gap is larger nearer the centre of the gap than at the ends of the edge faces.

14. A method of manufacturing the joint configuration of claim 1, comprising:

providing a first channel portion for directing fluid flow in a first direction and having a first edge at an angle divergent from the first direction, the first edge having a first edge face with a depth between a top of the first edge face and a bottom of the first edge face and a length extending from one end of the first edge face to the other;

providing a second channel portion for directing fluid flow in a second direction and having a second edge at an angle divergent from the second direction, wherein the second direction is at an angle of less than 180° relative to the first direction, the second edge having a second edge face with a depth between a top of the second edge face and a bottom of the second edge face and a length extending from one end of the second edge face to the other;

profiling at least one of the first edge face and the second edge face such that at least one of the first edge face and the second edge face is concave in shape along the length of the edge face; and arranging the first channel portion and the second channel portion such that the joint is a first joint between the first edge face of the first channel portion and the second edge face of the second channel portion, comprising a gap between the first and second channel portions provided by the at least one profiled edge face, the gap narrowing towards the ends of the edge faces.

15. The method of claim 14, further comprising:

providing the second channel portion with a third edge face at an angle divergent from the second direction and which is spaced from the second edge face in a longitudinal direction of the second channel portion, providing a third channel portion for directing fluid flow in a third direction with a fourth edge face which is not parallel to the third direction, wherein the third direction is at an angle of less than 180° relative to the second direction, profiling at least one of the third edge face and the fourth edge face in a concave shape; and arranging the second channel portion and the third channel portion such that the joint is a first joint between the third edge face of the second channel portion and the fourth edge face of the third channel portion, comprising a gap between the first and second channel portions provided by the at least one profiled edge face.

16. The method of claim 14, wherein the step of profiling comprises:

providing the respective edge face with a curve; and/or providing the respective edge face with at least two planar portions having at least one excluded obtuse angle between the planar portions;

wherein the angle is between 160° and 180°.

17. The method of claim 16, wherein the angle is between 170° and 180°.

18. The method of claim 14, wherein the channel portions comprise corrugated sheeting, arranged such that the longitudinal direction of the corrugations is parallel to the flow direction in the respective channel portion.

19. The method of claim 15, wherein the channel portions comprise corrugated sheeting, arranged such that the longitudinal direction of the corrugations is parallel to the flow direction in the respective channel portion.

20. The heat exchanger of claim 5, wherein the heat exchanger is a plate and fin heat exchanger, and wherein a fin of the heat exchanger comprises the joint configuration.

* * * * *